US005169135A

United States Patent [19]

Hamanaka et al.

[11] Patent Number: 5,169,135

[45] Date of Patent: Dec. 8, 1992

[54] RECIRCULATING DOCUMENT HANDLER

[75] Inventors: Izumi Hamanaka; Kazuhiro Hirota, both of Hachioji, Japan

[73] Assignee: Konica Corporation, Tokyo, Japan

[21] Appl. No.: 876,138

[22] Filed: Apr. 29, 1992

Related U.S. Application Data

[63] Continuation of Ser. No. 503,875, Apr. 3, 1990, abandoned.

[30] Foreign Application Priority Data

Apr. 6, 1989 [JP] Japan ..... 1-89091

[51] Int. Cl.[5] ..... B65H 3/00

[52] U.S. Cl. ..... 271/3.1; 271/301

[58] Field of Search ..... 271/3.1, 301

[56] References Cited

U.S. PATENT DOCUMENTS 4,921,236 5/1990 Saeki ..... 271/3.1

4,934,683 6/1990 Ueda ..... 271/3.1

*Primary Examiner*—Richard A. Schacher

*Attorney, Agent, or Firm*—Finnegan, Henderson, Farabow, Garrett and Dunner

[57] ABSTRACT

The invention relates to a document handling apparatus for use in a copying machine which separates a document from the bottom of a stack of documents on a loading plate to an exposure location, feeds back the document onto the top of the stack after exposure. The document handling apparatus has a separator arm fixed to a rotatable shaft which is driven intermittently by a drive system. The separator arm contacts the top surface of the stack of documents to be fed to the exposure location with the weight of the arm, loads the documents having been returned from the exposure location on the separator arm, moves downwardly with the circulation of the documents until being released from the bottom of the stack of the documents. A partially toothed gear of the drive system is mounted on a rotatable shaft which is geared with the pinion gear to rotate the rotatable arm in its toothed circumferential portion and is free from the pinion gear out of the toothed circumferential portion. A sensor is provided to detect a position of the separator arm for generating a signal to stop a motor of the drive system.

6 Claims, 7 Drawing Sheets

RECIRCULATING DOCUMENT HANDLER

This application is a continuation of application Ser. No. 07/503,875, filed Apr. 3, 1990, now abandoned.

BACKGROUND OF THE INVENTION

This invention relates to a document separator of a recirculating document handler which separates and feeds stacked documents on a document loading plate one by one to the exposure location on a platen glass surface, ejects and returns exposed documents from the exposure location to the document loading plate. More particularly this invention relates to a document separator which separate documents to be fed to the exposure location from documents to be returned to the document loading plate after exposure.

Conventionally, a recirculating document handler (RDH) is mounted in a copying machine which is structured so that stacked documents to be fed are loaded on a document plate, sequentially separated one by one by a friction separation means installed on the feed end side of the stacked documents starting at the lowest sheet of the stacked documents, and fed to a predetermined location on a glass surface (platen glass) of the document, and exposed documents are ejected and returned to the document loading plate and stacked on the top of the unfed stacked documents.

In the foregoing circulating document handler it is required to detect the recirculation of documents. Generally, a separator arm (sometimes called sorter arm) is placed on the top of stacked documents on the document loading plate beforehand, and exposed documents are sequentially loaded on the separator arm. When the last document which is directly pressed by the separator arm is fed to the exposure location, the separator arm is removed from the document loading location, and when the last page is returned to the document loading plate and loaded on the top of the exposed stacked documents, the separator presses the top of the stacked documents again.

The separator arm may be installed at the back end of the stacked documents on the document loading plate in the feed direction or on the side of the stacked documents. The side installation type is available for a document conveyor which aligns only one side of stacked documents of various sizes loaded on the document loading plate against one side of the document loading plate which is a reference plane but not suited to a document conveyor which aligns the center of the document width.

A recirculating document handler with a separator arm installed at the back end of documents in the feed direction is indicated in Japanese Patent Examined Publication No. 1981-40338 and U.S. Pat. No. 4,164,347.

When a rotating motor is used to drive the separator arm to place it on the top of stacked documents on the document loading plate, it is difficult to accurately control the motor because, the thickness of stacked documents varies.

In a document circulator indicated in Japanese Patent Laid-Open 1985-83024, by allowing a motor to run for a predetermined time, the separator arm rotates by a drive lever which is integrated with the motor shaft, touches the documents, if any, on the document loading plate, and stops. Then, the motor overloads and locks, and the rotation stops (auto shut off). As documents are sequentially fed and the stacked documents under the separator arm reduce in number, the separator arm moves downward by the weight thereof keeping in contact with the stacked documents. When the stacked documents run out, the separator arm moves down to a cutout space under the document loading plate and stops.

However, when the separator arm touches the stacked documents and stops, the separator arm strongly presses the top surface of the stacked documents and stops by a motor lock, so that the overpressure of the separator arm may cause damage to the documents. When the motor ON time from the contact of the separator arm with the top surface of the documents to the stoppage of the motor is too short, the separator arm may be reversed in rotation and returned to the original location.

When the motor ON time is too long, the paper feed resistance becomes high because the separator arm presses the top surface of the documents by the drive of the motor during document feed, causing paper feed errors, scratches on document surfaces, or soiled document images.

An optimum motor ON time depends on the document paper quality and varies with the number of documents (stacked document thickness), so that it is impossible to set the motor ON time to a predetermined value.

SUMMARY OF THE INVENTION

One object of the present invention is to provide a highly reliable recirculating document handler which is free of the foregoing conventional disadvantages, accurately places a separator arm on stacked documents on a document loading plate, and surely removes or moves up the separator arm when all the documents are circulated.

More particularly the object of the present invention is to provide a separator unit which does not depend on the document thickness, surely operates, and causes no damage to documents.

The above object is accomplished by a circulating document conveyor which separates and feeds stacked documents on a document loading plate one by one, and then returns the document after exposure, and loads the document on the document loading plate and which is characterized in that the recirculating document conveyor comprises a document sorter means comprising a rotatable sorter arm member for separating the circulation of the stacked documents on the document loading plate, a detecting means for detecting the rotating position of the sorter arm member, and a drive means for intermittently driving a shaft member which is integrated with the arm member and a movable part of the detecting means.

The drive means is characterized in that the drive means comprises a pinion gear which is directly connected to the drive source and a semicircular cutout gear which can be engaged to or disengaged from the pinion gear.

The above circulating document conveyor is characterized in the configuration that when the arm member is driven and rotated to near the top surface of the stacked documents, the pinion gear and the cutout gear are disengaged from each other to cut off the drive transmission, and the arm member presses the stacked documents by its weight.

BRIEF DESCRIPTION OF THE DRAWINGS

FIGS. 1 to 8 show embodiments of the present invention, wherein FIG. 1 is a front sectional view of a document circulating conveyor, FIG. 2 is a perspective view of a document ejection unit, FIG. 3 is a partial perspective view of the document ejection unit, FIG. 4 is an illustration of a document ejection belt and the drive of a back end limit plate, FIG. 5 is a perspective view of a document ejection unit including a document sorter and the vicinity thereof, FIG. 6 is a sectional view of the document sorter, FIG. 7 is a perspective view of the document sorter, and FIG. 8 is an illustration of the operation of the document sorter.

DETAILED DESCRIPTION OF THE EMBODIMENTS

Figure 1:
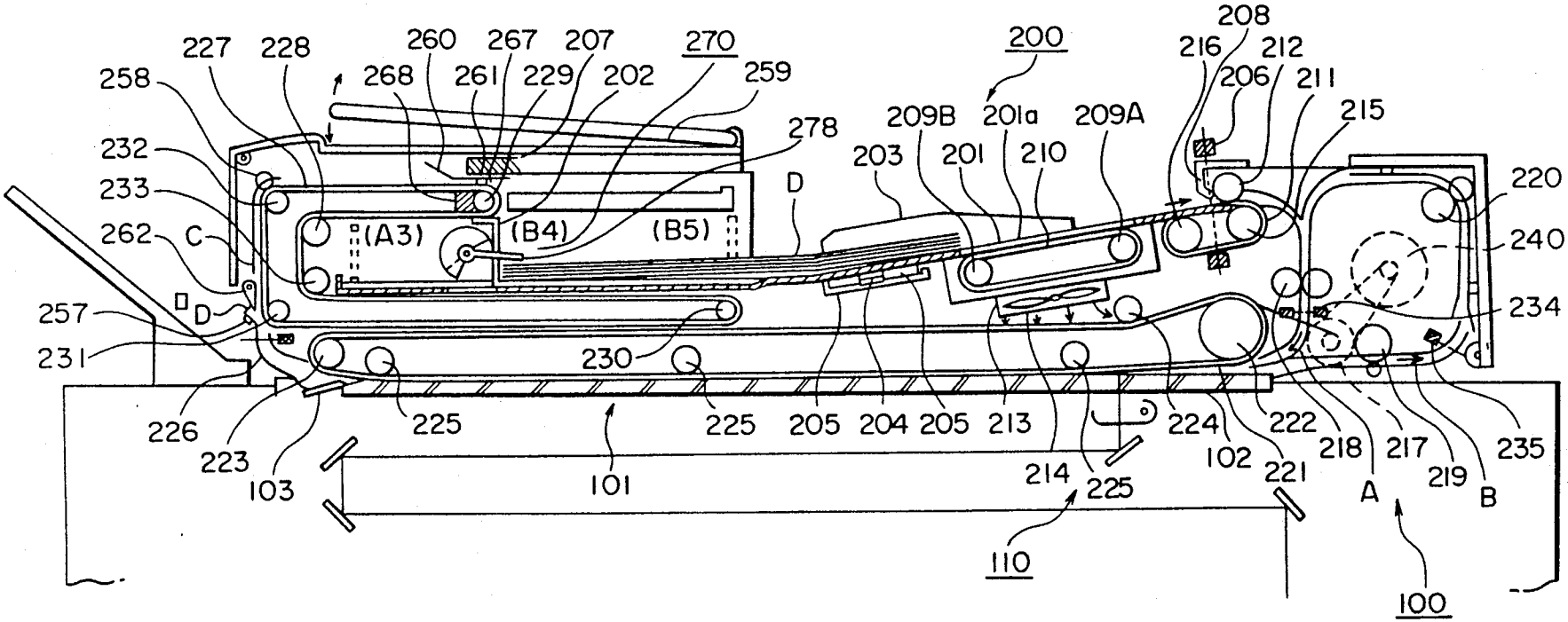

Embodiments of the present invention will be described in detail hereunder with reference to the accompanying drawings. In the case of FIG. 1, numeral 100 designates the main unit of a copying machine and 200 a circulating document conveyor. The document conveyor 200 comprises a document loading plate 201 which is in the ascending inclination state in the document feed direction, and the document loading plate 201 comprises a back end limitation plate 202 for holding the back end of documents D when the documents D are set on the document loading plate and a width limitation plate 203 for limiting the crosswise location of the documents D. The width limitation plate 203 is linked to a pair of racks 205 and 205 which slide in the width direction with a pinion gear 204 located between the racks under the document loading plate 201, and can move symmetrically to the center and the displacement of the plate 203 is detected by a sensor which is not indicated in the figure so as to recognize the width of the documents D. The back end limitation plate 202 provides a function for pressing the tail end of the documents D set on the document loading plate 201 up to the detection location (fixed location) of a stack sensor 206. Numeral 207 designates a document set detection sensor for detecting whether the documents D are set on the document loading plate 201.

Numeral 208 designates a document stopper which is installed near a document inlet of the document loading plate 201 in the document feed direction. The document stopper 208 is fixed to the frame of the document feeder, and a predetermined parallel gap is provided between the bottom of the document stopper and the top of the document loading plate 201. The document stopper 208 provides a function for holding and aligning the head of the document D to be fed which is returned to the document loading plate 201 after circulation on a platen glass 102 as described later for the next feeding.

Numeral 210 designates a press belt for pressing the documents D on the predetermined location up to the document feed location as mentioned above. The press belt 210 is a perforated belt stretched between rollers 209A and 209B.

Numeral 211 designates a document feed belt for feeding the documents D starting with the lowest document, and 212 a stop roller which is in pressure-contact with the document feed belt 211 so as to prevent double feeding of the documents D, and these, as a whole, form a separation means. The document feed belt 211 is stretched between drive rollers 215 which are linked to the main motor 240 via an electromagnetic clutch (not indicated in the figure) mounted to the shaft of the document feed belt 211 and via a one-way control means and a follower roller 216, and the surface of the upper belt is slightly protruded from the top of the document loading plate 201.

The press belt 210 is installed in each of through-holes 201A which are located sideways at a plurality of points on the document loading plate 201. The head of the pressed-out document is inserted into the nip (drive portion) between the document feed belt 211 and the stop roller 212 in a wedge form.

Numeral 213 designates a suction box which is installed so as to enclose the press belts 210 from the bottom of the document loading plate 201. The suction box 213 is structured so that the lowest one of the documents D is held by the suction of a suction fan 214 through the gaps between the through-holes 201*a* and the press belts 210 and the belt holes so as to make the press-out force of the press belts 210 effectual.

The letter A indicates a forward path for leading each document D which is fed from the foregoing document feed mechanism onto the platen glass 102 of the copying machine 100, and the letter B a reverse path for reversing the document D after exposure. The reverse path B is used for reversing even pages of double-side documents toward the platen glass 102 or for reversing the page sequence once again when returning the reversed and exposed documents D to the document loading plate 201, and joined to the upper part of the forward path A in an upward loop from the surface of the platen glass 102. Numeral 218 designates conveyor rollers installed halfway the forward path A, and 219 and 220 conveyor rollers installed halfway along the reverse path B. The conveyor rollers 218, 219, and 220 are linked to the main motor 240 via a one-way control mechanism so as to rotate in the same feed direction.

Numeral 221 designates a conveyor belt for conveying documents to the platen glass 102 in the forward direction or reverse direction. The conveyor belt 221 is stretched between a first roller 222 on the document feed side which is linked to the main motor 240 via a forward-reverse change means 217 and a second roller 223 on the document ejection side. A tension roller 224 is in pressure-contact with the surface of the upper belt of the conveyor belt 221 on the first roller 222 side, and the surface of the lower belt is in contact with the platen glass 102 so as to slide thereon by a plurality of press rollers 225, 225, and 225.

The first roller 222 and the second roller 223 are linked to each other via a timing belt which is not shown in the figure. In the forward (clockwise in FIG. 1) rotation, the conveyor belt 221 moves by the drive force from the first roller 222 and the lower belt thereof is loose. In this case, the second roller slides by a one-way clutch. When the conveyor belt 221 rotates in the reverse direction (counterclockwise), the one-way clutch is locked and the second roller 223 drives the conveyor belt 221. Therefore, the conveyor belt 221 rotates by the drive force of the first roller 222 or by the drive force of the second roller 223. This function is particularly effectual when a document D is exposed in synchronization with feeding on the platen glass 102.

Numeral 103 designates a document stopper which is installed at the end of the platen glass 102 on the document feed side and protrudes up and retracts down from the surface of the platen glass 102.

In circulating copy mode, the document D is conveyed on the platen glass and the exposure optical system 110 keeps a fixed position. In this case the stopper 103 retracts from the surface of the platen glass 102. In other mode, such as SDF mode, the document D stops at an exposure location and the exposure optical system moves to expose the document. In this case the stopper 103 protrudes from the surface of the platen glass to align the exposure location of the document.

Numeral 226 designates a document ejection guide plate connected to the outlet side of the platen glass 102 and 227 a document ejection belt. The document ejection belt 227 is supported immediately behind the document loading plate 201 in the feed direction, and stretched so as to enclose the back side of the document loading plate 201 in a C shape by a drive roller 228 which is linked to the main motor 240 via a one-way control mechanism, upper and lower end rollers 229 and 230 which are supported so as to move horizontally along the upper and lower surfaces of the document loading plate 201, and auxiliary rollers 231, 232, and 233 which are supported near the document ejection guide plate 226. The document ejection belt 227 conveys a document D which is sent from the conveyor belt 221 in the document ejection direction by the rotation of the drive roller 228 in a predetermined direction.

Figure 2:
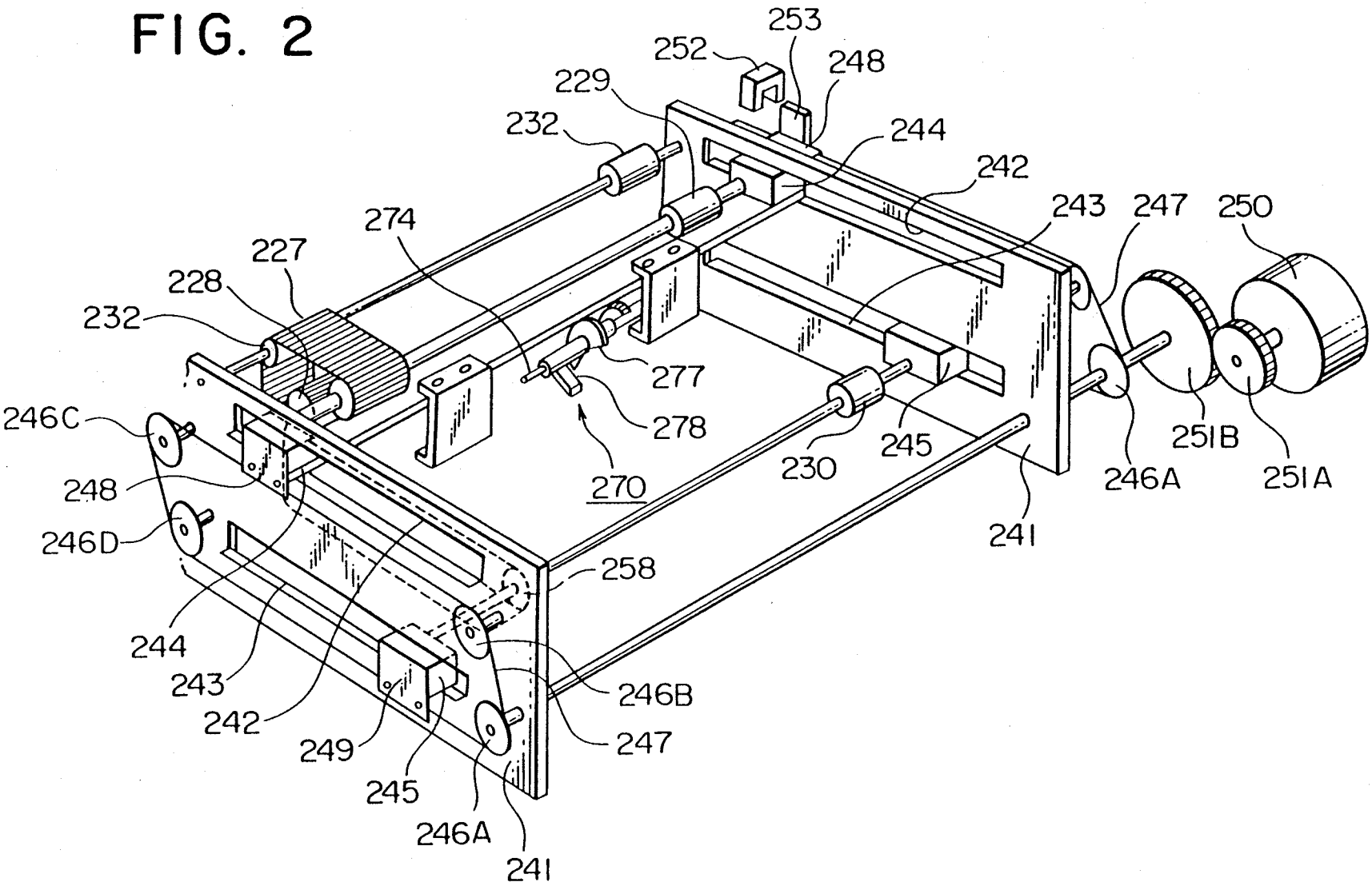
Figure 3:
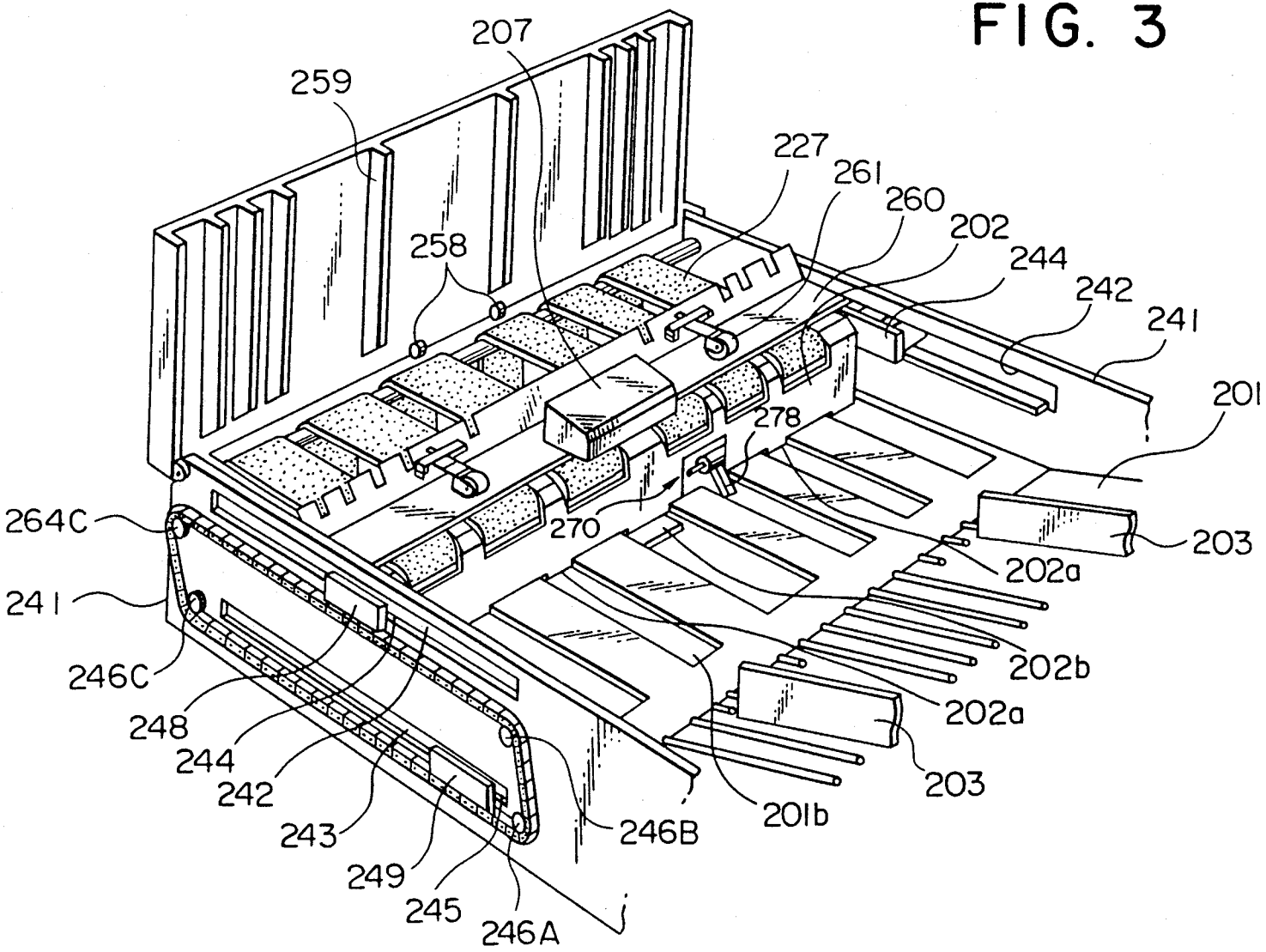

The upper and lower end rollers 229 and 230 of the document ejection belt 227, as shown in FIGS. 2 and 3, are supported respectively between an upper stage movable unit 244 and a lower stage movable unit 245 which are retained in the slidable state in parallel two-stage horizontal grooves 242, 242, 243, and 243 which are mounted to frames 241 and 241 on both sides of the document conveyor 200 via roller members, and the movable units 244 and 245 are connected to the upper side and lower side of a chain 247 which is stretched between sprockets 246A, 246B 246C, and 246D each pair of which are supported before and after the both-side frames 241 and 241 via attachments 248 and 249. The sprocket 246A on the lower part of the front is linked to a reversible chain drive source 250 via intermediate gear rows 251A and 251B. Therefore, when the chains 247 and 247 run by the forward and reverse rotations of the chain drive source 250, the upper end roller 229 and the lower end roller 230 rotate in the opposite directions, and the tension of the document ejection belt 227 is always kept constant.

The document ejection belt 227 is configured as a movement control mechanism of the back end limitation plate 202 for holding the end of the documents D when setting them on the document loading plate 201, and the back end limitation 202 is mounted to the upper stage movable unit 244 so as to cover the front of the upper end roller 229. At the lower edge thereof, as shown in FIG. 3, a convex part 202*a* of a shallow concave-convex part installed on the back top of the document loading plate 201 parallel with the document feed direction which is engaged to a concave part 201*b* is installed so as to prevent a pressed document from moving downward.

In FIGS. 2 and 3, numeral 252 designates a home position sensor for the back end limitation 202, and the sensor 252 decides the location which is cut off by a cut-off member 253 mounted to the attachment 248 connected to the upper part of the chain 247 as a home position of the back end limitation plate 202. This home position is a position where a document of a maximum size (for example, size A3) is held.

Figure 4:
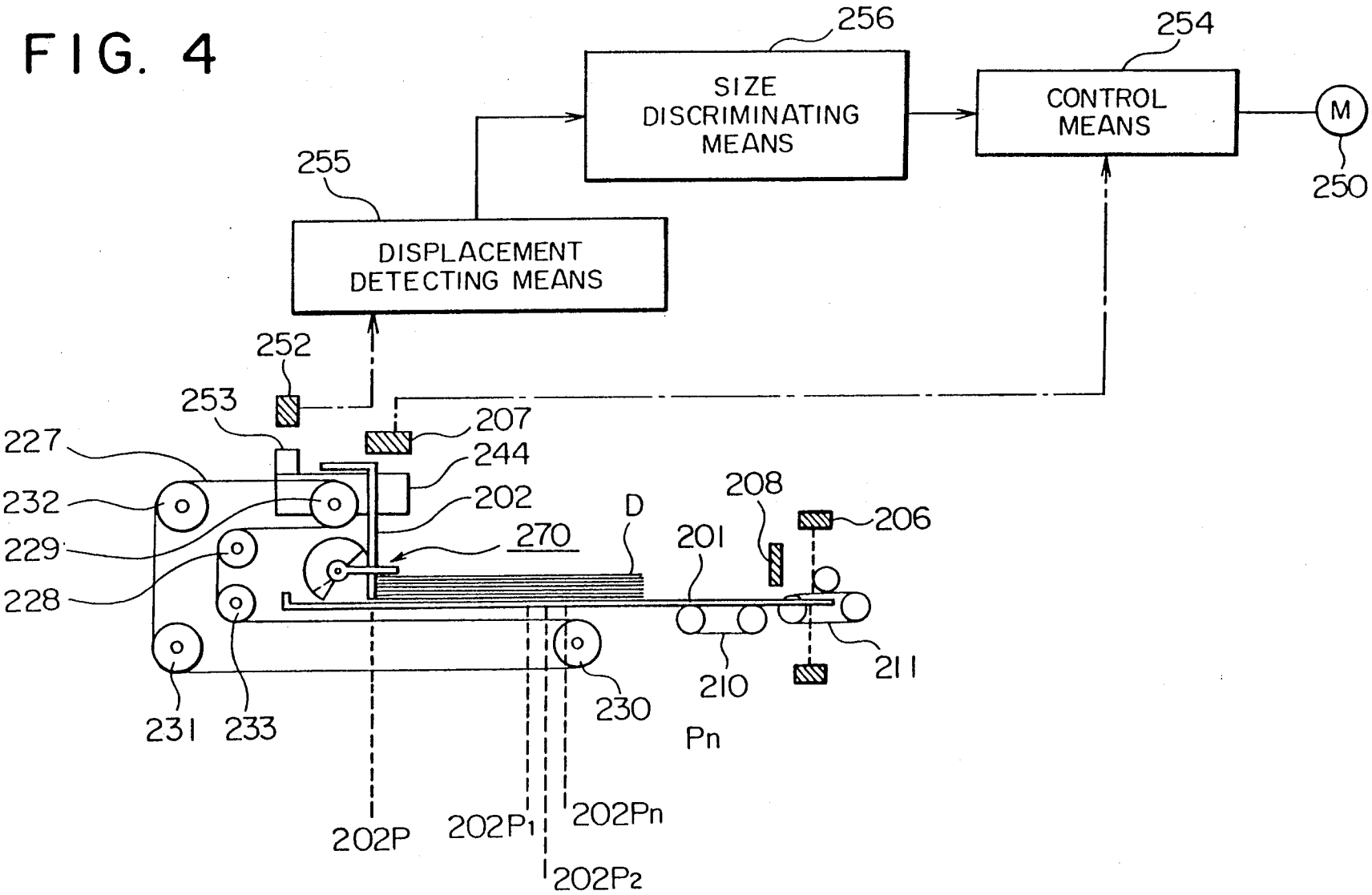

The forward or reverse rotation and rotation speed of the chain drive source 250 are controlled, as shown in FIG. 4, by a control means 254. When the document set sensor 207 confirms that documents are set on the document loading plate 201, the control means 254 allows the chain drive source 250 to rotate in the forward direction by an ON signal from a copy button and the back end limitation plate 202 to advance from a home position $202P_1$ which is a start point. The document set sensor 207 moves together with the back end limitation plate 202 and detects a moving document D. Therefore, when the document D is removed from the document loading plate 201 for some reason during movement or immediately after the movement is finished, the document set sensor 207 detects it immediately, and a detection signal is transferred to the control means 254 and the chain drive source 250 is stopped.

To discriminate the document size, the document conveyor comprises a detecting means 255 for detecting the displacement from the initial position 202P of the back end limitation plate 202 which is detected by the home position sensor 252 to the advance point (stack sensor detection point) $202P_1$, $202P_2$, —, or $202P_n$, and a means 256 for discriminating the document size from the measured displacement. The discriminating means 256 comprises a memory circuit for storing a plurality of document size data (for example, A4, A3, B4, B5, etc.) which correspond to the displacement, and a selection circuit for selecting necessary document size data from the memory circuit according to output from the displacement detecting means 255.

The memory circuit of the discriminating means 256 stores a plurality of document size data as well as unsuitable size data (for example, B5, or smaller sizes), and outputs an operation inhibition signal to the control unit of the main motor when the memory circuit discriminates the document size as an unsuitable size. Discriminated result of the discrimination means 256 is also transmitted to a control unit of the main unit of the copying machine which selects and feeds copying papers of a suitable size.

Numerals 257 and 258 designate press rollers which are in contact with the document ejection belt 227 at the location corresponding to the auxiliary rollers 231 and 232, 259 a top guide plate which is connected to the upper part of the back of the side frames 241 and 241 of the document conveyor 200, 260 a document outlet guide plate which is installed so as to be opposite to the upper stage movable unit 244 bearing the upper end roller 229 with a slight gap above the top of the upper belt of the document ejection belt 227, and 261 a press roller which is in contact with the document ejection belt 227 from the top of the document outlet guide plate 260 through the through-holes. Numeral 207 designates a document set sensor for detecting whether documents D are set on the document loading plate 201.

The document set sensor 207 is fixed on the document outlet guide plate 260 with the front thereof protruded forward. There is a through-hole in the lower part of the front of the frame for mounting the sensor 207 thereon, and irradiating light from the inside of the frame of the sensor 207 and reflected light to the sensor 207 pass through the through-hole of the frame. The sensor 207 contains a light irradiating unit which comprises a LED and a phototransistor and a light receiving unit in the same frame. Light irradiated from the light irradiating unit (LED) passes through the through-hole of the frame and reaches a reflection plate 202*b* which protrudes forward from the lower edge of the back end limitation plate 202. The reflected light from the reflection plate 202*b* passes through the through-hole of the frame once again and reaches the light receiving unit (phototransistor).

Figure 5:
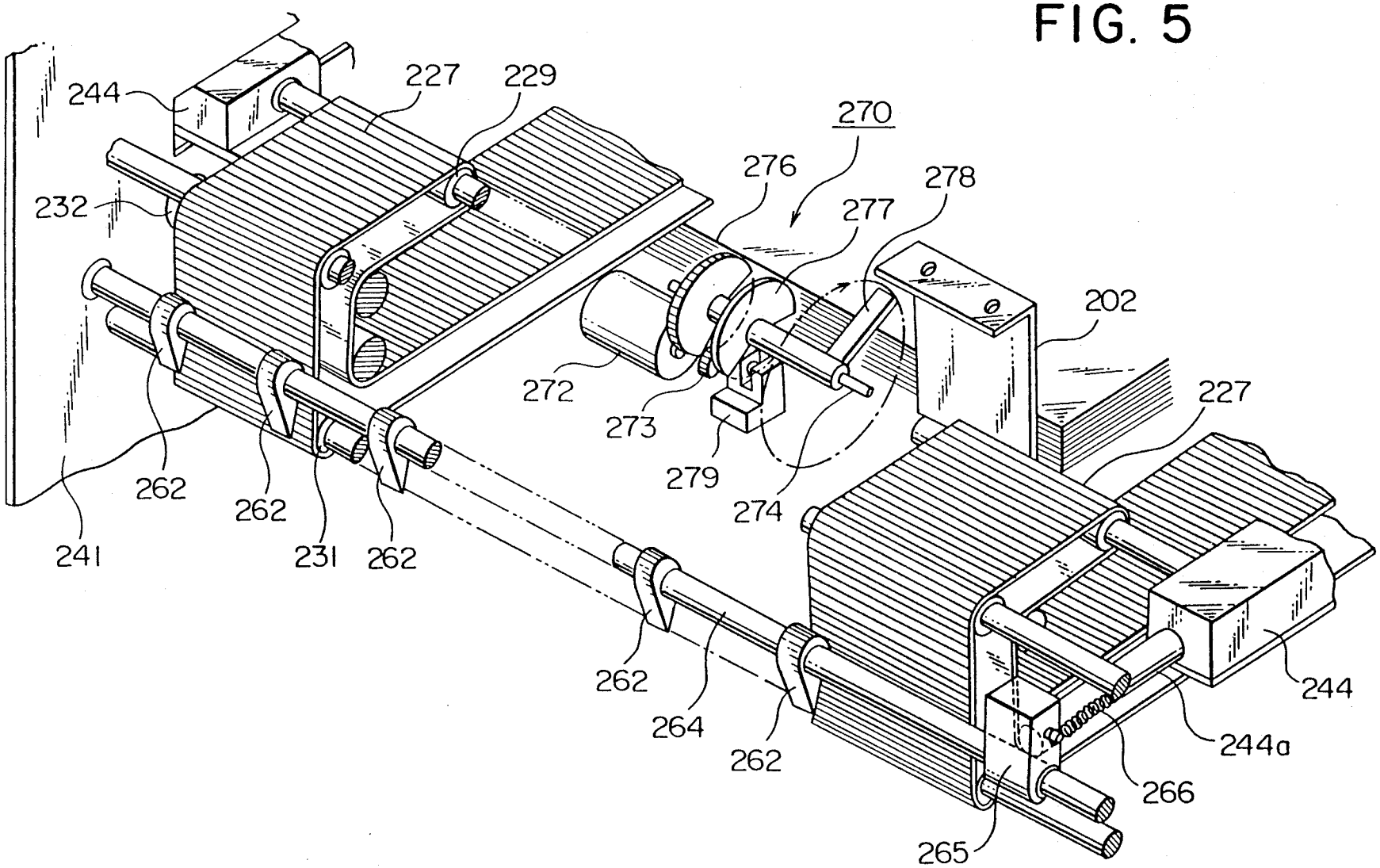

Numeral 262 designates a change pawl for changing a circulating document ejection path C installed halfway the document ejection guide plate 226 through which a processed document moves to the document loading plate 201 or an extra-machine document ejection path D through which a document moves to an extra-machine document ejection tray 263. When the back end limitation plate 202 returns to the home position, the change pawl 262 opens the extra-machine document ejection path D, and when the back end limitation plate 202 is not in the home position, the change pawl 262 opens the circulating document ejection path C. As shown in FIG. 5, the change pawl 262 is fixed to a support shaft 264 which is born by the side frames 241 and 241 so as to rotate. A contact plate 265 is fixed to the inside of the end of the support shaft 264, and when a protrusion 244*a* mounted to one end of the upper stage movable unit 244 presses the contact plate 265, the change pawl 262 operates. When the upper stage movable unit 244 is stopped in the home position, the change pawl 262 continues the operation thereof and opens the extra-machine document ejection path D. When the upper stage movable unit 244 moves and separates from the home position, the head of the protrusion 244*a* separates from the surface of the contact plate 265, a spring 266 mounted to the upper part of the contact plate 265 pulls the contact plate 265, and the change pawl 262 opens the circulating document ejection path C.

Figure 7:
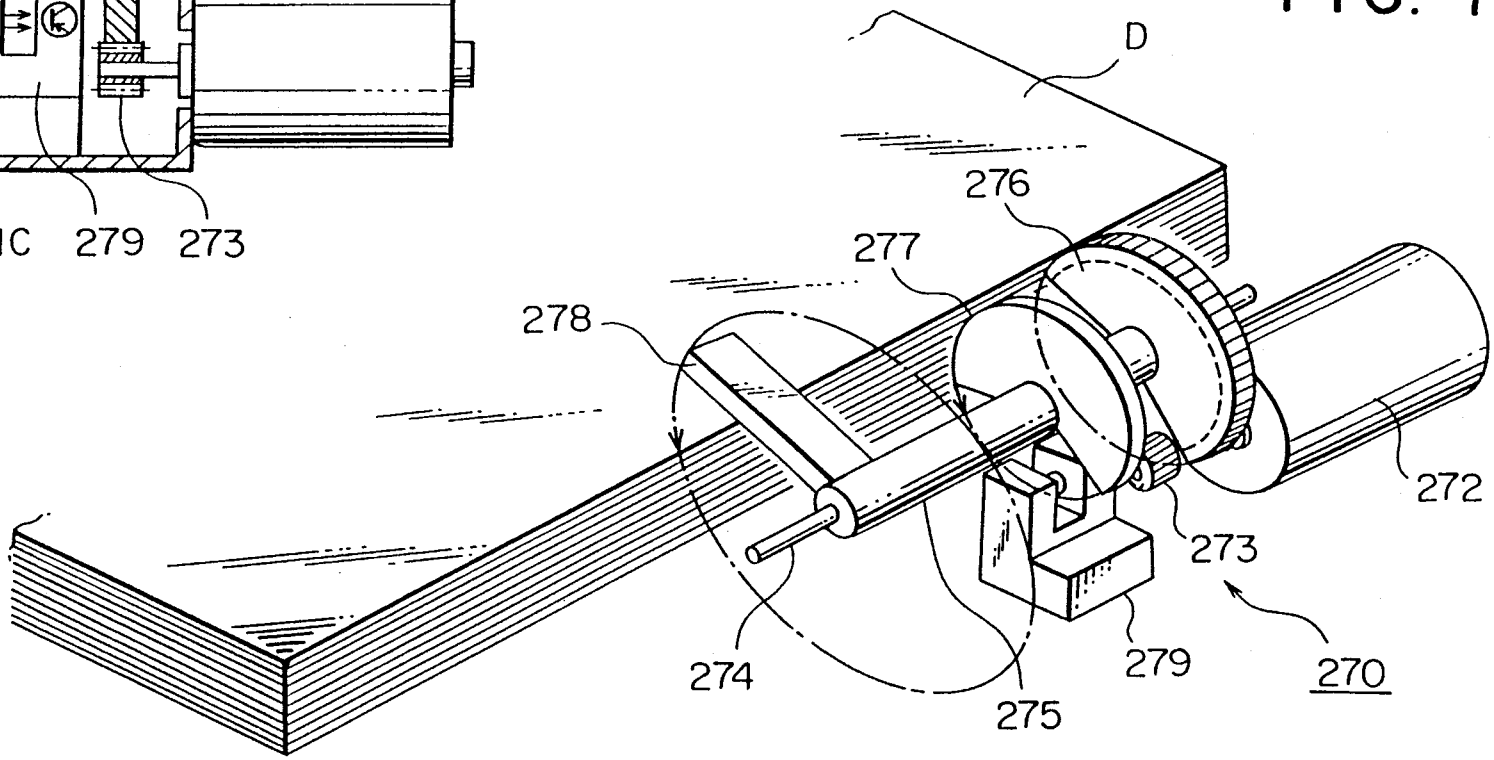
Figure 6:
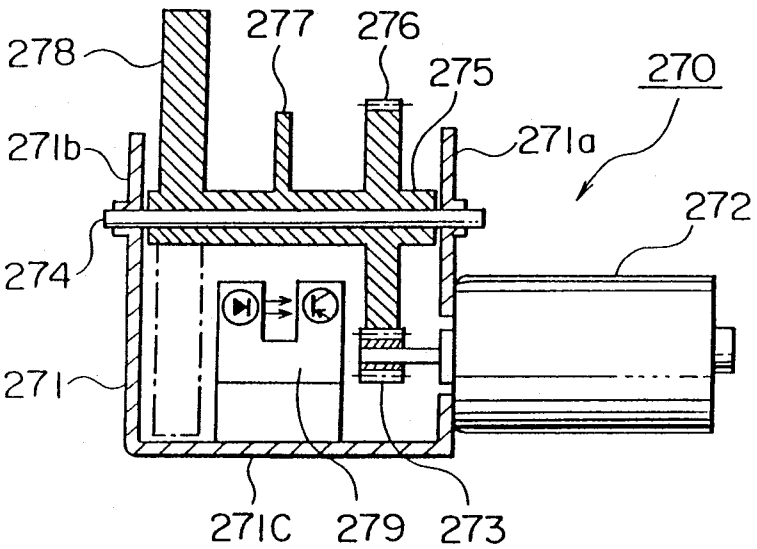

The upper stage movable unit 244 comprises, as mentioned above, the upper end roller 229, the back end limitation plate 202, and the document set sensor 207. Furthermore, the document sorter 270 is suspended near the center of the upper stage movable unit 244 as a part thereof (shown in FIGS. 1, 2, 3, 4, and 5). FIG. 6 is a sectional view of the document sorter 270 and FIG. 7 is a perspective view thereof.

The U-shape frame 271 is fixed to the upper stage movable unit 244 and moves in the document ejection direction or in the reverse direction together with the upper stage movable. The motor (for example, a DC motor) 272 is fixed to the wall 271*a* of the frame 271. The pinion gear 273 is fixed to the shaft of the motor 272.

The support shaft 274 is installed between both walls 271*a* and 271*b* of the frame 271. The rotating shaft 275 is engaged to the support shaft 274 so as to rotate. The rotating shaft 275 is integrated with a semicircular cutout gear 276, the fan-shaped shield plate 277, and the separator arm 278. A sensor 279 is installed at the bottom 271*c* of the frame 271, and the shield plate 277 passes through the concave detection space thereof. A proximity sensor such as a photointerrupter (transmission type optical coupling device), a light emitting diode and a phototransistor, a photoreflector (reflection type optical coupling device), a hall device, an electrostatic capacity sensor, or a vibrator sensor can be used as a sensor.

Figure 8:
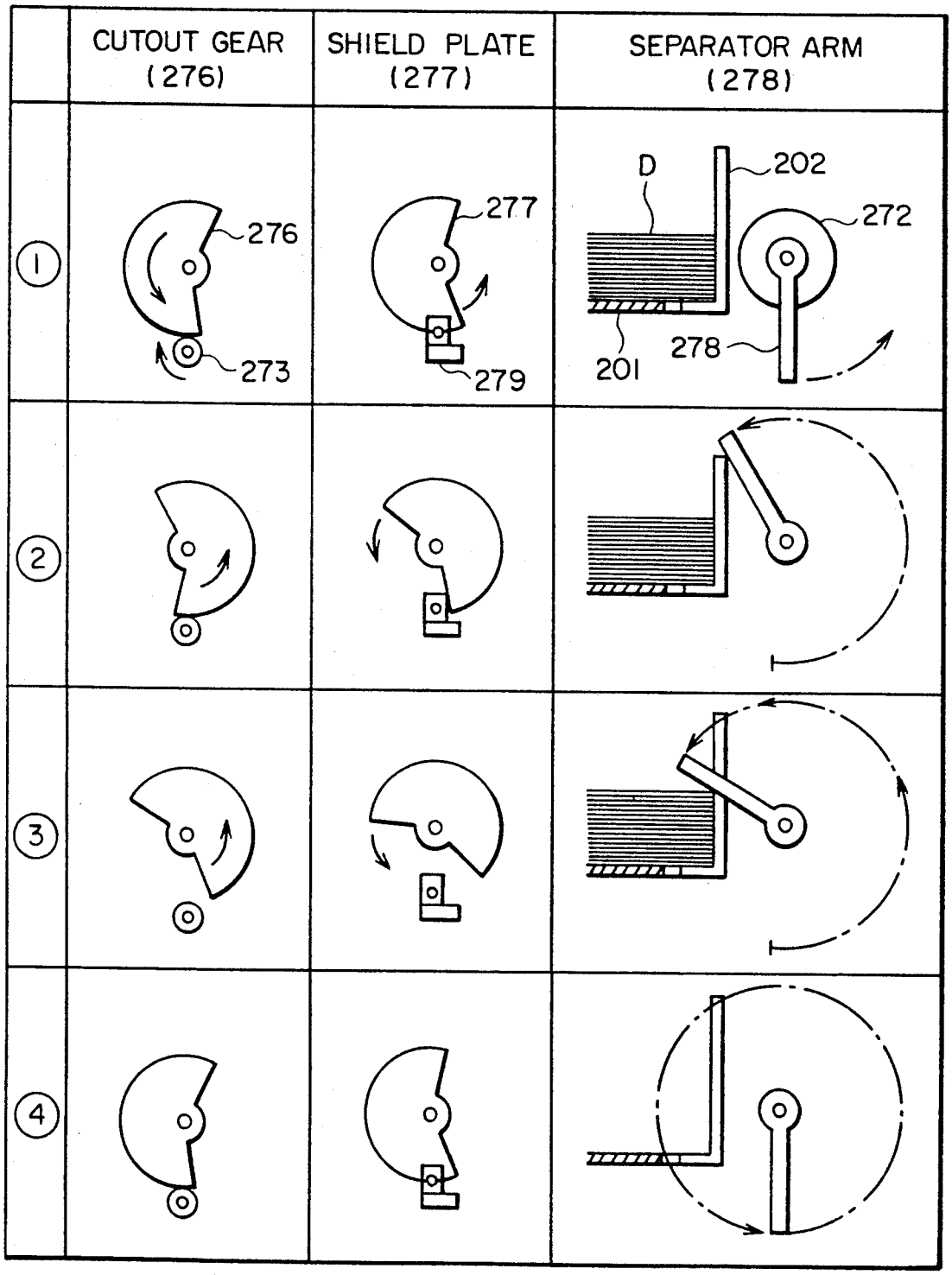

Next, the operation of the document sorter 270 of the present invention will be described with reference to the illustration shown in FIG. 8.

(1) Documents which are stacked up in the page sequence with the copy side up are set in the back end limitation plate 202 located at the home position with the back end of the documents aligned by the plate. The location of the documents in the width direction is limited by the width limitation plates 203 and 203, the number of copy documents is entered, and the copy button is pressed. By doing this, the motor 272 is turned on, the pinion gear 273 integrated with the motor shaft is driven, and the cutout gear 276 geared to the pinion gear, the shield plate 277 and the separator arm 278 both rigidly connected to the cutout gear shaft start rotation in the direction of the arrow.

(2) The motor continues to drive the pinion gear 273 to rotate in an arc of 200 degree. The pinion gear 273 and the cutout gear 276 are kept geared until the separator arm moves beyond the upright position (top dead point), and the cutout gear 276, the shield plate 277, and the separator arm 278 continues to. When the pinion gear 273 is further driven to rotate, the cutout portion of the cutout gear 276 appears, the gearing state is released, and the drive force of the pinion gear 273 is not transferred. Then, the separator arm 278 which enters the inclination state begins to rotate downwards by the weight thereof. The shield plate 277 opens the light transfer path of the sensor 279, a motor stop signal is generated, the switch is turned off, and the motor 272 is stopped.

(3) The separator arm 278 falls rotateably by the weight thereof and presses the top document of the stacked documents D. As documents D under the separator arm 278 are fed and the stacked documents decreases in number, the separator arm 278 moves down gradually, and circulated documents D are simultaneously stacked up above the separator arm 278.

(4) When the number of documents under the separator arm 278 is reduced to 0, the separator arm 278 falls rotateably under the document loading plate 201 and stops near the bottom dead point. At the bottom dead point, the shield plate 277 shuts off the optical path of the sensor (photointerrupter), generates a bottom dead point arrival detection signal, and displays a completion of one circulation of the stacked documents. Just before the arm stoppage position, the toothed portion of the cutout gear 276 is geared to the pinion gear 273.

When the main motor 240 starts to drive the rollers 209A and 209B and the press belt 210, the documents D are pushed out toward the nip between the document feed belt 211 and the stop roller 212. Since the document feed belt 211 is kept in the no-rotation state by the operation of the electromagnetic clutch at this time, the pushed-out documents enter into the nip between the document feed belt 211 and the stop roller 212 in a wedge form with the lowest document as the first and the upper documents succeeded to stop there.

Then, the electromagnetic clutch is turned on, and the document feed belt 211 rotates in the document feed direction. Since the stop roller 212 in contact with the document feed belt 211 is kept in the no-rotation state at this time, the lowest document is sent by the document feed belt 211, and other documents are held by the stop roller 212 so as to prevent double feeding. With the document feed roller 211, the press belt 210 also rotates in synchronization with the roller 211, and separates and holds the lowest document by suction from the stacked documents and presses out the document in the document feed direction.

A document sent by the document feed belt 211 enters the forward path A, and is nipped by the conveyor roller 218 installed halfway the forward path A and is conveyed toward the platen glass 102 and the conveyor belt 221 at the synchronization exposure speed. After the head of the document crosses a synchronization sensor 234 installed halfway the forward path A (right under the conveyor roller 218), the electromagnetic clutch is turned off after the time predetermined for each size.

The document conveyed by the conveyor roller 218 is exposed by the fixed optical system 110 by being conveyed on the platen glass 102 by the conveyor belt 221 at the synchronization exposure speed to form an image on the photosensitive drum. The document D after exposure moves up along the document ejection guide plate 226 and is ejected by the document ejection belt 227 toward the document loading plate 201. Since the press rollers 257, 258, and 261 which are in contact with the roller support of the document ejection belt 227 through the through-holes from the outer surface of the document ejection guide plate 226 constituting the document outlet guide plate 260 and the document ejection path support the document D, even if a document outlet 267 changes the location thereof according to the document size, the document sent from the platen glass 102 by the conveyor belt is surely nipped by the conveyor belt and the document outlet 267, never causing no document ejection.

The document D ejected on the document loading plate 201 is aligned the front and back ends by the document stopper 208 and the back end limitation plate 202 and the width by the width limitation plates 203 and 203, and then stacked once again. The above sending operation is repeated in the sending timing and at the synchronization conveying speed which are predetermined for each copy size and magnification until the documents D on the document loading plate 201 run short.

The above operations are available for one-side copy of one-side documents in the RDH mode. In this case, the document stopper 103 mounted to the end of the platen glass 102 of the copying machine 100 on the document ejection side is under the platen glass 102, and the exposure optical system 110 is in the fixed location mode.

When double-side documents are copied on one side in the RDH mode, documents sent from the document loading plate 201, as mentioned above, are fed to the plate glass 102 via the forward path A, and the last page is on the top of the stacked documents on the platen glass 102. Therefore, it is necessary (1) to stop a document which is sent on the platen glass 102, (2) to reverse the conveyor belt 221, send the document to the reverse path B, reverse the document in a somersault state so that the last page is at the bottom, and expose the document on the platen glass 102 by the fixed optical system 110, and (3) to reverse the conveyor belt 221 once again after exposure, correct the page sequence by passing the document through the reverse path B, reverse the page side so that the other page side faces downward, expose the document on the platen glass 102, and return the document to the document loading plate 201. By repeating the operations (1), (2), and (3), the one-side copy of double-side documents is finished.

When copying both sides of documents, it is necessary to return the unexposed document to the document loading plate 201 in operation (3), and copy even pages during the first circulation and odd pages during the second circulation. It is natural that copying of odd pages requires no reverse operation. Needless to say, the paper feed operation of the copying machine 100 is performed in synchronization with the above document conveying operation.

When the processing is completed in any mode, the synchronization sensor 234 detects passing of the last document, and a copy operation end signal is sent from the CPU after the time corresponding to the size.

As mentioned above, in the recirculating document handler of the present invention, documents which are set or restacked on a document loading plate circulates from the document loading plate, via a document feed unit and a processing unit, back to the document loading plate in a closed loop path. The separator arm for separating the stacked documents on the document loading plate contacts with the documents, and moves up rotationally by the drive force of a motor and moves down by the weight thereof correctly and smoothly. The document separation is performed stably and causes no damage to the documents and the document processing is efficiently performed.

What is claimed is:

1. A document handling apparatus for use in a copying machine in which the document is exposed by copying means to form a copy image, comprising:

means for circulating a stack of documents placed on a loading plate by separating a document at the bottom of the stack of documents, feeding said document to the copying means and returning the exposed document onto the top of said stack of documents;

a separator arm for monitoring circulation of the stack of documents to be fed, wherein said separator arm is fixed to and rotatable around a rotatable shaft so that said separator arm is loaded on top of the stack of documents to be fed, and moves downwardly with the circulation of the stack of documents and loads the return documents thereon, until being released from the bottom of the stack of return documents;

detecting means for detecting a position of said separator arm; and driving means for driving said separator arm through a rotating interval starting from a bottom dead position of said separator arm through a top dead position to a predetermined disconnecting position, which disconnects said separator arm at said disconnecting position so as to make said separator arm free from said driving means, said predetermined disconnecting position being an inclined position of said separator arm where said separator arm overhands the top surface of said stack of said documents.

2. A document handling apparatus for use in a copying machine in which the document is exposed by copying means to form a copy image, comprising:

means for circulating a stack of documents placed on a loading plate by separating a document at the bottom of the stack of documents, feeding said document to a copying means and returning the exposed document onto the top of said stack of documents;

a separator arm for monitoring circulation of the stack of documents to be fed, wherein said separator arm is fixed to and rotatable around a rotatable shaft so that said separator arm is loaded on top of the stack of documents to be fed, and moves downwardly with the circulation of the stack of documents and loads the return documents thereon, until being released from the bottom of the stack of return documents;

detecting means for detecting a position of said separator arm; and driving means for driving said separator arm in accordance with the detected position, wherein the driving means comprises:

a pinion gear connected to and driven by a motor, and a cutout gear having a toothed circumferential portion mounted on the rotatable shaft which is meshed with said pinion gear in a toothed circumferential portion thereof to rotate the rotatable shaft through the pinion gear and is released from the pinion gear in a portion out of the tooth circumferential portion thereof to make the rotatable shaft free from the pinion gear.

3. The document handling apparatus of claim 2, wherein the detecting means comprises:

a sensor; and a rotating member mounted on said rotatable shaft and rotating simultaneously with said separator arm, said rotating member shaped so as to provide said sensor with positional information of said separator arm.

4. The document handling apparatus of claim 3, wherein:

said rotating member indicates to said sensor a position of said separator arm at which said separator arm is inclined above the surface of said stack of documents; and said rotating member further indicates a position of said separator arm at which said separator arm has been released from the bottom of a stack of documents.

5. The document handling apparatus of claim 2, wherein the driving means drives the rotatable shaft to rotate said separator arm from a suspended position to the inclined position of the separator arm above the stack of documents, makes the rotatable shaft free from the pinion gear so that the separator arm falls rotatably by its weight to contact the surface of the stack of documents to be fed, keeps falling rotatably in accordance with the circulation of the stack of documents and comes back to the suspended position after being released from the bottom of the stack of the returned documents, thereat the cutout gear meshes with the pinion gear again.

6. The document handling apparatus of claim 5, wherein the sensor generates a signal to stop the motor at the inclinated position of the separator arm.

* * * * *